US008249261B2

(12) United States Patent
Kiepfer et al.

(10) Patent No.: US 8,249,261 B2
(45) Date of Patent: Aug. 21, 2012

(54) METHOD FOR THREE-DIMENSIONAL PRESENTATION OF A HEARING APPARATUS ON A HEAD AND CORRESPONDING GRAPHICS FACILITY

(75) Inventors: Andreas Kiepfer, Erlangen (DE); Wee Haw Koo, Singapore (SG)

(73) Assignee: Siemens Medical Instruments Pte. Ltd., Singapore (SG)

( * ) Notice: Subject to any disclaimer, the term of this patent is extended or adjusted under 35 U.S.C. 154(b) by 927 days.

(21) Appl. No.: 12/291,176

(22) Filed: Nov. 6, 2008

(65) Prior Publication Data

US 2009/0123001 A1 May 14, 2009

(30) Foreign Application Priority Data

Nov. 12, 2007 (DE) ..... 10 2007 053 832

(51) Int. Cl.
*H04R 29/00* (2006.01)

(52) U.S. Cl. ..... 381/60

(58) Field of Classification Search ..... 381/58–61
See application file for complete search history.

(56) References Cited

U.S. PATENT DOCUMENTS

| | | | |
|---|---|---|---|
| 5,056,204 A | 10/1991 | Bartschi | |
| 6,633,289 B1 | 10/2003 | Lotens et al. | |
| 6,700,586 B1 | 3/2004 | Demers | |
| 6,920,414 B2 | 7/2005 | Topholm | |
| 2002/0138237 A1 | 9/2002 | Topholm | |
| 2003/0123026 A1 | 7/2003 | Abitbol | |
| 2004/0165740 A1 | 8/2004 | Fang | |
| 2005/0088435 A1 | 4/2005 | Geng | |
| 2011/0182451 A1* | 7/2011 | Vaarbroe et al. | 381/322 |

FOREIGN PATENT DOCUMENTS

| | | |
|---|---|---|
| EP | 1246506 A1 | 10/2002 |
| JP | 2007108254 A | 4/2007 |
| WO | 9923609 A1 | 5/1999 |

OTHER PUBLICATIONS

Skeletal animation From Wikipedia, the free encyclopedia edited by David C (talk | contribs) at 04:54, May 10, 2007; Others; 2007; pp. 1-2.

A Morphable Model for the Synthesis of 3D Faces, Volker Blanz Thomas Vetter, Max-Planck-Institut für biologische Kybernetik, Tübingen, Germany (http://www.kyb.tuebingen.mpg.de/bu/people/volker/morphmod2.pdf); Others; 1999; pp. 1-8.

* cited by examiner

*Primary Examiner* — Benjamin Sandvik
*Assistant Examiner* — Whitney T Moore

(57) ABSTRACT

A method and a graphics facility are provided to allow a choice of hearing apparatus to be made easier for a user via a three-dimensional presentation of a hearing apparatus on a head of a user. A 3D model of the hearing apparatus is provided as a virtual hearing apparatus and a 3D model of the head of the user or of a part thereof is obtained as a virtual head. The virtual hearing apparatus is subsequently aligned to the virtual head so that the virtual head can be presented graphically in three dimensions along with the fitted virtual hearing apparatus. This especially allows different types and colors of hearing apparatus to be represented in an animation on the user's head.

15 Claims, 3 Drawing Sheets

FIG 2
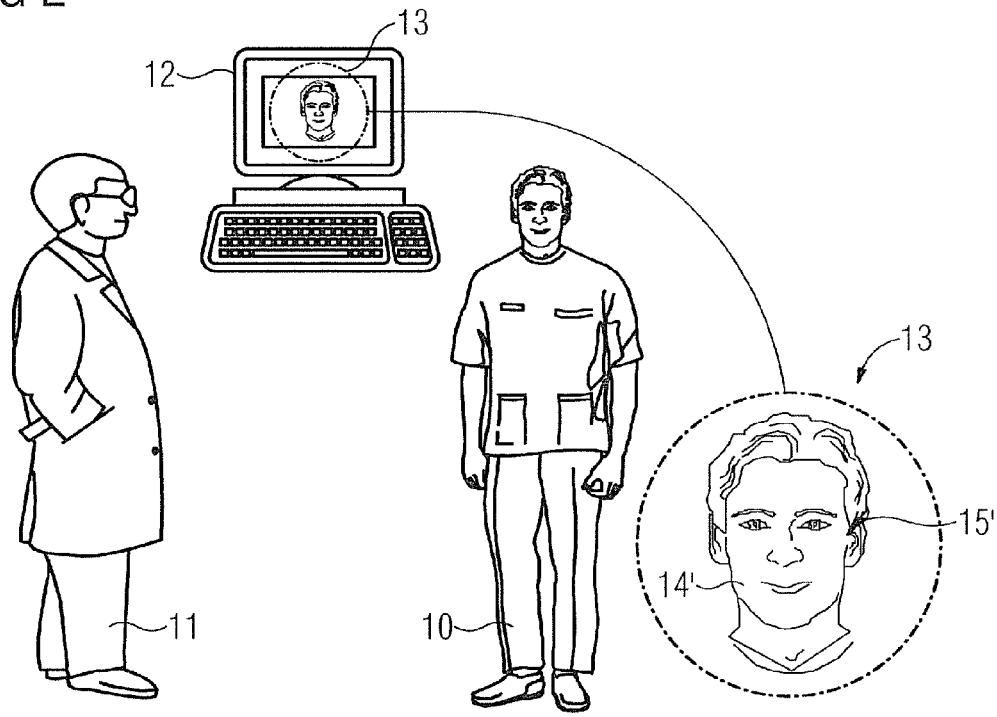
FIG 3
FIG 4
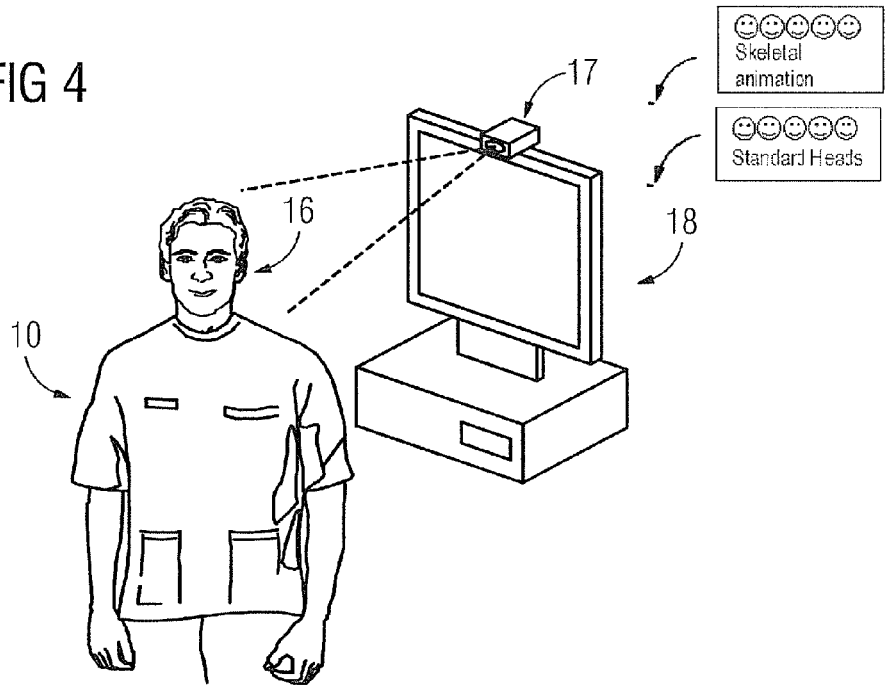

METHOD FOR THREE-DIMENSIONAL PRESENTATION OF A HEARING APPARATUS ON A HEAD AND CORRESPONDING GRAPHICS FACILITY

CROSS REFERENCE TO RELATED APPLICATIONS

This application claims priority of European Patent Office application No. 10 2007 053 832.6 EP filed Nov. 12, 2007, which is incorporated by reference herein in its entirety.

FIELD OF INVENTION

The present invention relates to a method for presentation of a hearing apparatus on a head of a user. The present invention also relates to a corresponding graphics facility for representing a hearing apparatus. The term "hearing apparatus" here is to be understood as any device outputting sound worn in or on the ear, especially a hearing device, a headset, headphones and such like.

BACKGROUND OF INVENTION

Hearing devices are wearable hearing apparatus used to assist those with impaired hearing. To meet the numerous individual requirements different designs of hearing device are provided, such as behind-the-ear (BTE) hearing devices, receiver-in-the-canal (RIC) hearing devices, in-the-ear (ITE) hearing devices and also Concha or in-canal (ITE, CIC) hearing devices. The typical configurations of hearing device are worn on the outer ear or in the auditory canal. Above and beyond these designs however there are also bone conduction hearing aids, implantable or vibro-tactile hearing aids available on the market. In such hearing aids the damaged hearing is simulated either mechanically or electrically.

Hearing devices principally have as their main components an input converter, an amplifier and an output converter. The input converter is as a rule a sound receiver, e.g. a microphone, and/or an electromagnetic receiver, e.g. an induction coil. The output converter is mostly implemented as an electroacoustic converter, e.g. a miniature loudspeaker or as an electromechanical converter, e.g. bone conduction earpiece. The amplifier is usually integrated into a signal processing unit. This basic structure is shown in FIG. 1, using a behind-the-ear hearing device as an example. One or more microphones 2 for recording the sound from the surroundings are built into a hearing device housing 1 worn behind the ear. A signal processing unit 3, which is also integrated into the hearing device housing 1, processes the microphone signals and amplifies them. The output signal of the signal processing unit 3 is transmitted to a loudspeaker or earpiece 4 which outputs an acoustic signal. The sound is transmitted, if necessary via a sound tube, which is fixed with an otoplastic in the auditory canal, to the hearing device wearer's eardrum. The power is supplied to the hearing device and especially to the signal processing unit 3 by a battery 5 also integrated into the hearing device housing 1.

SUMMARY OF INVENTION

Subjective aesthetic impressions play a major part in the selection and fitting of hearing devices. Thus acousticians often have demonstration devices able to be tried on by those with impaired hearing. This applies especially to BTE devices, which can be suspended behind the ear. As a rule however it is unlikely to be case that the acoustician can supply a demonstration device of exactly the right color, the desired shape of a suitable otoplastic etc. With ITE devices the problem is even greater since the user will not be able to be provided with a demonstration device which fits into their auditory canal and has the required output. Thus the user will not be able to imagine a new device on his or her head.

For optical demonstration of a hearing device while it is being worn there has long been reliance on fitting software in which a photo of a woman can be seen wearing a predetermined hearing device in a standard color. This image is designed to help the hearing-impaired imagine how the hearing device might appear when they wear it. This only succeeds in a few cases however.

A CAD/CAM system for designing a hearing device is known from publication EP 1 246 506 A1. The contour is determined from the auditory canal of a user and a 3D computer model generated therefrom. The model is completed using one or more databases. Finally a hearing device shell is produced from the completed model.

Publication US 2003/0123026 A1 further discloses a fitting system for eyeglasses. A photograph of the user is taken. Using a database archive, a 3D model of the user's face is produced from this photograph. A 3D representation of eyeglasses is fitted into the 3D model of the face and the result is graphically displayed.

Further publications U.S. Pat. No. 5,056,204, US 2004/0165740 A1 and US 2005/0088435 A1 likewise disclose systems for creating 3D images of an auditory canal as well as manufacturing methods for manufacturing otoplastics from these 3D images.

The object of the present invention is thus to support a potential user of a hearing apparatus in selecting a device in respect of its aesthetic aspects.

Inventively this object is achieved by a method for presentation of a hearing apparatus on a user's head through provision of a 3D model of the hearing apparatus as a virtual hearing apparatus, obtaining a 3D model of the user's head or of a part thereof as a virtual head, alignment of the virtual hearing apparatus to the virtual head and graphic representation of the virtual head with the fitted virtual hearing apparatus.

In addition a graphics facility is provided for presentation of a hearing apparatus on a user's head, comprising a memory device for provision of a 3D model of the hearing apparatus as a virtual hearing apparatus, an optical device for obtaining a 3D model of the user's head or of a part thereof as a virtual head, a computing device for alignment of the virtual hearing apparatus to the virtual head and a graphics facility for graphical representation of the virtual head with the fitted virtual hearing apparatus.

In an advantageous manner it is thus possible to present a not yet manufactured virtual hearing device or a corresponding other hearing apparatus directly on the "user". In particular for example the person with impaired hearing can be given a visual presentation of the new hearing device during the sales negotiations. In other words, with the inventive method or the inventive graphics facility, it is possible to show or present to the user an image or a mirror image of them including a new hearing device, since the acoustician will certainly not have the actual appropriate device available as a demonstration device.

Preferably the virtual head is obtained from the digital data of a standard head and at least one digital photograph of the user's head or of the part thereof. In this case the standard head can especially be selected from a number of standard heads. This significantly reduces the computing effort for creating a three-dimensional virtual head.

Advantageously the virtual head is created with the aid of a skeletal animation from the standard head. This skeletal animation again makes a significant contribution to reducing the computing effort.

In addition it is useful for the design of the virtual head to employ image recognition to determine the shape and/or the position of a predetermined point of the photograph. Thus for example the chinbone and the cheekbone can be automatically detected and the standard head can be modified in accordance with the photography.

The virtual hearing apparatus can for example be provided from a database containing a number of such hearing apparatuses. A preselection or final selection of the hearing apparatus can thus be undertaken without any computing overhead.

For the fitting of for example an ITE hearing device it is of advantage for the corresponding virtual hearing apparatus to be obtained by scanning the auditory canal of the user with subsequent 3D model generation. This especially enables an impression to be obtained of how far the hearing device can be pushed into the auditory canal.

BRIEF DESCRIPTION OF THE DRAWINGS

The present invention will be explained in greater detail with reference to the enclosed drawings, which show:

FIG. 2 a sketch of the situation for an acoustician with a 3D view of a head;

FIG. 3 an enlarged section from FIG. 2;

FIG. 4 a sketch for photographic imaging of an area of a user's ear;

DETAILED DESCRIPTION OF INVENTION

Figure 1:
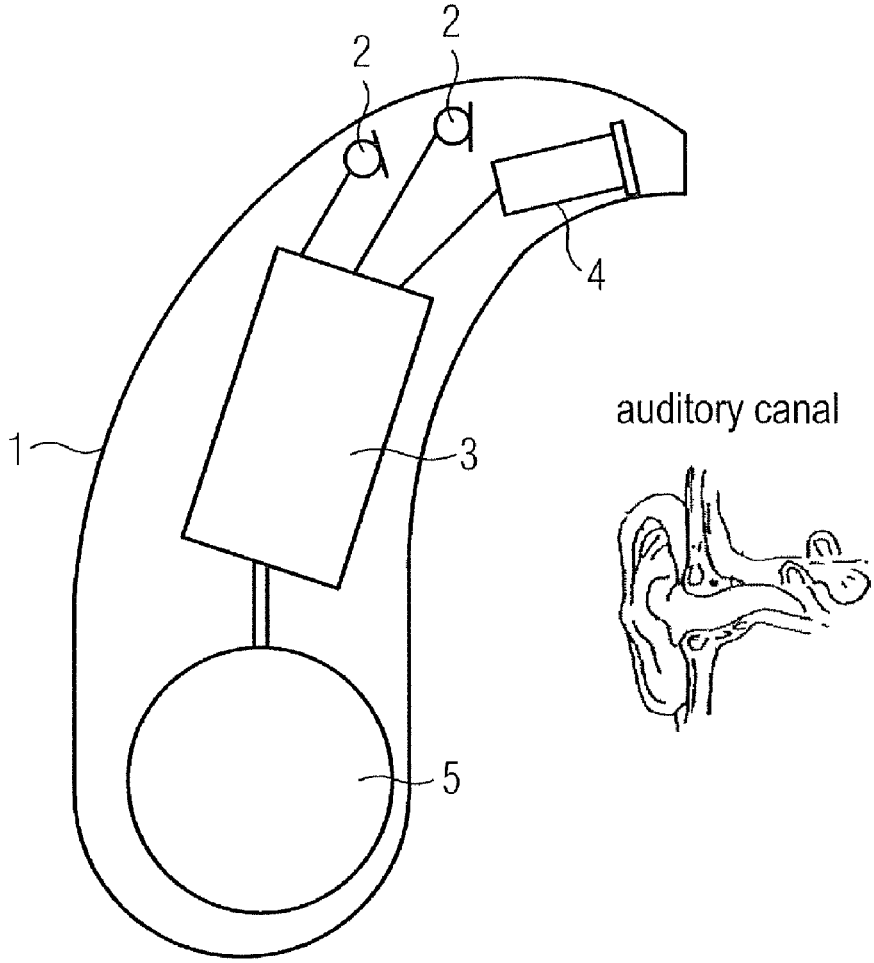
FIG 1 (Prior art)
FIG. 1 the basic structure of a hearing device and a schematically shown ear possessing an auditory canal in accordance with the prior art.

The exemplary embodiments described in greater detail below represent preferred embodiments of the present invention.

FIG. 2 shows a situation in which a person with hearing impairment 10 seeks an acoustician 11 to have a hearing device fitted for them. To provide the person with impaired hearing with the most realistic possible idea of the new or future hearing device, the acoustician 11 creates a virtual 3D image for the head of the person with impaired hearing 10. To do this the acoustician needs at least three 2D images or photographs of the head. Commercially-available webcams or also digicams are suitable for recording the image. To create a 3D model of the head it is best to make use of a database with standard heads, from which a natural image of the head of the person with impaired hearing 10 can be created. It then only remains necessary to seek out a possible appropriate standard head and modify the significant parts of the head in accordance with the photographs. Image recognition can be used for this purpose for example, which recognizes the ears, the eyes, the eyebrows, the lips, the nose or the cheekbones. On the basis of this recognition, the shape and position of the corresponding parts of the standard head can then be modified. To do this, it is once again useful to use the known technology of skeletal animation, since modifications can be made with less computing effort based on simple skeletal or framework drawings. On this basis the final 3D model of the head can be synthesized, which is also possible with known technologies (morphing).

A 3D model of the hearing device to be used is available for example for BTE hearing devices in the form of CAD data in a database. In the case of ITE hearing devices scan data or the data of prefabricated ITE shells can also serve as the basis for the respective 3D model.

Two 3D models, that of the head and that of the hearing device, are now available which are to be merged together in order to create the virtual space. For this step a so-called "alignment algorithm" is used, with which the hearing device, the tube, the RIC or the earpiece are fitted exactly behind or in the ear. This is done by merging the two 3D models into each other, so that eventually one 3D model of the virtual head of the person with impaired hearing 10 together with a selected hearing device is available. Finally from this 3D model an image 13 according to FIG. 2 can be displayed on a screen 12 of a fitting device on which fitting software runs.

FIG. 3 shows an enlarged section of the image 13. The figure thus shows not only the virtual head 14', but also the virtual hearing device 15'. The two items, both the head 14' as also the hearing device 15', are available as a three-dimensional data record, so that the image 13 can be rotated accordingly. This allows the person with impaired hearing 10 to view their head 14' with the attached hearing device 15' virtually from different perspectives. This makes it simple to modify and to present the type, the color and the size of the virtual hearing device 15.

FIGS. 4 to 7 show a somewhat simplified embodiment of the present invention. In accordance with this exemplary embodiment, only one ear section 16 of the person with impaired hearing 10 is photographed or recorded for forming the 3D model of a part of the head. Within the context of the present document this head section will also be referred to as a "virtual head". To obtain the recording, a webcam or video camera 17 is installed on the screen 18 of a PC, which serves as a fitting device.

Figure 5:
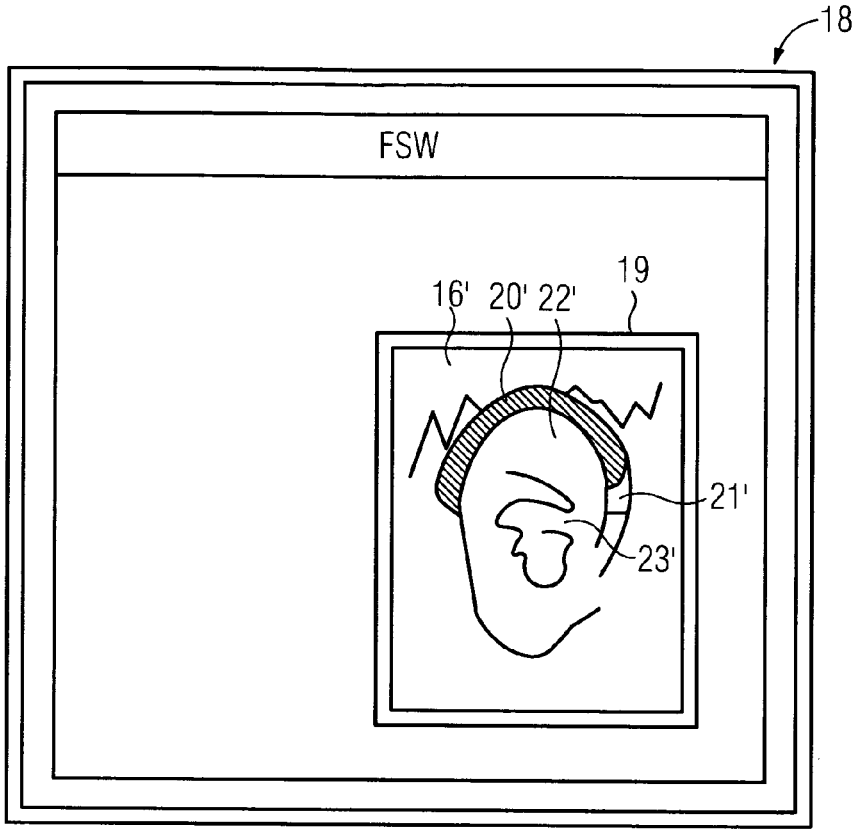
FIG. 5 a screen view of an area of a user's ear with virtual hearing device from the side.

FIG. 5 now shows an image which can be presented on the screen 18 with the aid of fitting software (FSW). A 3D video is shown in a section of the screen as a virtual head section 16' with a virtual hearing device 20'. It can also be seen from this figure how the virtual earpiece tube 21' of the virtual BTE hearing device 20' is fed around the virtual auricle 22' and comes out in a virtual otoplastic 23' in the center of the virtual auricle 22'.

FIG. 5 shows the virtual head section 16' from the side. However, in accordance with FIG. 6 a view of the virtual ear section 16' can also be presented from the front. Likewise in accordance with FIG. 7 it can be shown how the hearing device 20' appears from behind when being worn.

Figure 6:
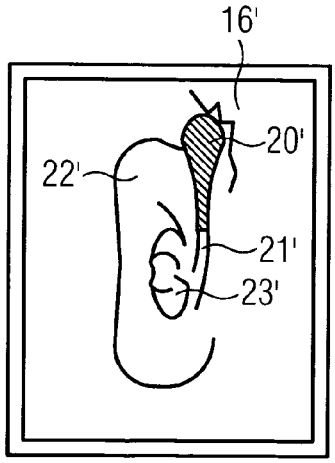
FIG. 6 the three-dimensional view of the ear with virtual hearing device from the front and FIG. 7 the three-dimensional view of the ear with virtual hearing device from the rear.
Figure 7:
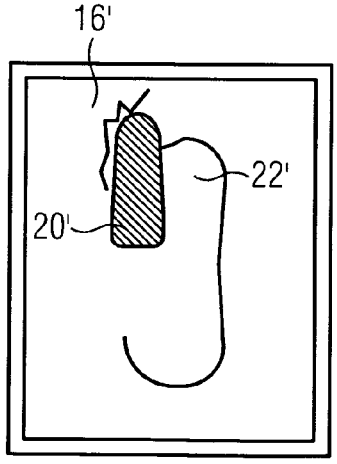

The virtual presentations can either be presented as individual images as in FIGS. 5 to 7 or within the framework of a moving video film. In such cases it is possible—as mentioned—to modify the model or the color of the hearing device shown. In particular BTE, ITE or CIC hearing devices can also be presented virtually. On the basis of these three-dimensional presentations the person with impaired hearing can then make a better decision about which hearing device to wear or about the color of said device. This increases satisfaction when wearing the hearing device at least as regards its appearance.

The invention claimed is:

1. A method for representing a hearing apparatus on a head of a user, comprising:

provisioning of a 3D model of the hearing apparatus as a virtual hearing apparatus;

obtaining a 3D model of the head of the user or of a part thereof as a virtual head;

aligning the virtual hearing apparatus with the virtual head and in accordance with a scan of the auditory canal to determine how far the hearing apparatus can be pushed into the auditory canal in order to fit the virtual hearing apparatus; and displaying a graphical presentation of the virtual head with the fitted virtual hearing apparatus.

2. The method as claimed in claim 1, wherein the virtual head is obtained from digital data of a standard head and at least one digital photograph of the head of the user or of a part thereof.

3. The method as claimed in claim 2, with the standard head being selected from a plurality of standard heads.

4. The method as claimed in claim 3, wherein the virtual head is created with the aid of a skeletal animation from the standard head.

5. The method as claimed in claim 2, wherein the virtual head is created with the aid of a skeletal animation from the standard head.

6. The method as claimed in claim 2, wherein the shape or position of a predetermined point of the photograph is determined using image recognition and included for the design of the virtual head.

7. The method as claimed in claim 2, wherein the virtual hearing apparatus is provided from a database with a plurality of different hearing apparatuses.

8. The method as claimed in claim 2, further comprises scanning the auditory canal of the user in order to help in the alignment.

9. The method as claimed in claim 8, wherein the graphical presentation indicates how far the hearing apparatus can be pushed into the auditory canal.

10. The method as claimed in claim 2, wherein the virtual hearing apparatus has not been manufactured.

11. The method as claimed in claim 1, wherein the shape and position of a predetermined point of the photograph is determined using image recognition and included for the design of the virtual head.

12. A graphics facility for representing a hearing apparatus on a head of a user, comprising:

a memory device that provisions a 3D model of the hearing apparatus as a virtual hearing apparatus;

an optical device that obtains a 3D model of the head of the user or of a part thereof as a virtual head;

a computing device that uses a scan of the auditory canal of the user to determine how far the hearing apparatus can be pushed into the auditor canal and aligns the virtual hearing apparatus to the virtual head in accordance with the scan of the auditory canal; and a graphics facility that graphical represents the virtual head with the fitted virtual hearing apparatus.

13. The graphics facility as claimed in claim 12, wherein the optical device generates a digital photograph of the head of the user or of the part thereof being such that the virtual head is generated from digital data of a standard head and from the digital photography.

14. The graphics facility as claimed in claim 13, wherein the optical device includes a scanner with which three-dimensional data of an auditory canal of the user is provided for forming the virtual hearing apparatus.

15. The graphics facility as claimed in claim 12, wherein the optical device includes a scanner with which three-dimensional data of an auditory canal of the user is provided for forming the virtual hearing apparatus.

* * * * *